US008393900B2

(12) United States Patent
Renntoft

(10) Patent No.: US 8,393,900 B2
(45) **Date of Patent: *Mar. 12, 2013**

(54) SYSTEM FOR ALIGNING A FIRING SIMULATOR AND AN ALIGNING UNIT FOR THE SAME

(75) Inventor: Per Renntoft, Skillingaryd (SE)

(73) Assignee: Saab AB, Linköping (SE)

( * ) Notice: Subject to any disclaimer, the term of this patent is extended or adjusted under 35 U.S.C. 154(b) by 2157 days.

This patent is subject to a terminal disclaimer.

(21) Appl. No.: 10/468,292

(22) PCT Filed: Feb. 7, 2002

(86) PCT No.: PCT/SE02/00204

§ 371 (c)(1),
(2), (4) Date: Aug. 19, 2003

(87) PCT Pub. No.: WO02/077561

PCT Pub. Date: Oct. 3, 2002

(65) Prior Publication Data

US 2004/0073393 A1 Apr. 15, 2004

(30) Foreign Application Priority Data

Mar. 23, 2001 (SE) ..... 0101063-6

(51) Int. Cl.

| | |
|---|---|
| ***F41G 3/32*** | (2006.01) |
| ***F41G 1/32*** | (2006.01) |
| ***F41G 1/54*** | (2006.01) |
| ***F41G 3/26*** | (2006.01) |
| ***F41A 33/00*** | (2006.01) |
| ***F41A 33/02*** | (2006.01) |
| ***G01B 11/26*** | (2006.01) |
| ***G01B 11/27*** | (2006.01) |
| ***G01C 1/00*** | (2006.01) |

(52) U.S. Cl. ..... 434/21; 434/11; 434/16; 434/17; 434/18; 434/19; 434/20; 434/22; 434/23; 434/24; 434/27; 356/144; 356/251; 356/139.05; 89/41.06

(58) Field of Classification Search ..... 434/11, 434/16–24, 27; 356/144, 251, 139.05; 89/41.06
See application file for complete search history.

(56) References Cited

U.S. PATENT DOCUMENTS 3,836,258 A * 9/1974 Courten et al. ..... 356/138
4,038,547 A * 7/1977 Hoesterey ..... 250/338.1

(Continued)

FOREIGN PATENT DOCUMENTS

WO WO 00/53993 * 9/2000

*Primary Examiner* — Nikolai A Gishnock
(74) *Attorney, Agent, or Firm* — Venable LLP; Jeffri A. Kaminski; Tamatane J. Aga

(57) ABSTRACT

A system for aligning a simulator arranged for firing a mounted on a weapon. The simulator has a radiation source arranged so as to emit a beam along a simulation axis, and for adjusting the simulation axis so that it is aligned with the weapon sight. The system includes a sighting mark at which the weapon sight is to be aimed during alignment, and a device arranged in connection with the sighting mark to emit beam along an axis representing an aligned simulation axis. The system further includes an aligning unit that is deployable at the simulator and in which at least a first part of the beam from the element is reflected along an axis representing the current position of the simulation axis. Position-indicator are arranged so that the beam along the axis representing the aligned beam strikes the position-indicator at a point representing a set-point value for the simulation axis, and so that the beam along the axis representing the current simulation axis strikes the position-indicator at a point representing an actual value for the simulation axis.

14 Claims, 3 Drawing Sheets

U.S. PATENT DOCUMENTS 4,136,963 A * 1/1979 Budden et al. ..... 356/251
4,173,414 A * 11/1979 Vauchy et al. ..... 356/139.08
4,364,628 A * 12/1982 Garner ..... 359/557
4,367,949 A * 1/1983 Lavering ..... 356/144
4,422,758 A * 12/1983 Godfrey et al. ..... 356/152.1
4,464,974 A * 8/1984 Goda ..... 89/41.06
4,689,016 A * 8/1987 Eichweber ..... 434/22
4,717,251 A * 1/1988 Wells et al. ..... 356/4.08
4,773,754 A * 9/1988 Eisele ..... 356/139.05
4,917,609 A * 4/1990 Eichweber ..... 434/20
4,963,096 A * 10/1990 Khattak et al. ..... 434/21
6,181,988 B1 * 1/2001 Schneider et al. ..... 701/3
6,406,298 B1 * 6/2002 Varshneya et al. ..... 434/21
7,192,282 B2 * 3/2007 Cederwall ..... 434/18
2002/0123025 A1 * 9/2002 Fouse et al. ..... 434/19
2005/0011103 A1 * 1/2005 Cederwall ..... 42/115
2005/0241210 A1 * 11/2005 Karcher et al. ..... 42/119
2008/0003543 A1 * 1/2008 Varshneya ..... 434/21

* cited by examiner

SYSTEM FOR ALIGNING A FIRING SIMULATOR AND AN ALIGNING UNIT FOR THE SAME

TECHNICAL AREA

This invention concerns a system for aligning a simulator arranged for firing and mounted on a weapon, which weapon has aiming means arranged to indicate the aiming of the weapon in a target area, wherein the simulator is equipped with at least one element arranged so as to emit an electromagnetic beam along a simulation axis and adjusting means to adjust the simulation axis so that it is aligned with the aiming means.

The invention also concerns an aligning unit for said system.

STATE OF THE ART

In simulated firing with a laser, the simulator emits a laser beam, or an electromagnetic beam generated by means of a technology other than laser technology. This beam can be detected by one or more detectors mounted on one or more targets. The emitted beam, e.g. the laser beam, exhibits different intensities in different directions of radiation, which are known collectively as the "laser lobe". The simulated effect of a weapon being fired at the target is achieved when the radiance from the laser lobe exceeds, at one of the targets at a given distance and in a given direction from the simulator, a detection threshold of a detector on the target.

When a simulator is mounted on a weapon, the firing direction of the simulator must be aligned with the firing directing of the weapon. This can be accomplished by aiming the weapon with its regular sight at a target that is designed so as to be able to sense the simulated firing of the simulator. The simulator is fired, and the target is observed to determine the locations of the hits in relation to the aiming of the weapon. If deviations are present, the firing direction of the simulator is adjusted by means of an adjusting device built into the simulator until the weapon and the simulator are jointly aligned. It may also be necessary to repeat the alignment process if the simulator is jostled somewhat from its position, e.g. as a result of exposure to minor impacts.

WO00/53993 describes a simulator device mounted on a weapon equipped with a sight. A simulation beam is generated in the simulator along a simulation axis. The simulator also emits an alignment beam along an alignment axis that is parallel with the simulation axis or has a fixed and known angle relative to the simulation axis. The weapon sight defines an aiming axis that indicates the direction in which a round will leave the weapon when live ammunition is fired. To enable alignment of the simulation axis of the simulator with the aiming axis, e.g. a retroreflector prism is arranged so as to reflect the incident alignment beam along the alignment axis back into the sight along the aiming axis. The alignment beam is thus visible through the sight, so that the alignment axis and the simulation axis can be collectively adjusted using appropriate means so that they coincide with the sight axis.

However, the foregoing simulator device is capable of use only with types of weapons wherein the distance between the sight and a barrel on which the simulator is mounted is not so great that it becomes unfeasible in practice to reflect the alignment beam from the simulator back into the sight.

U.S. Pat. No. 5,410,815 describes a system for automatic sight alignment of a laser transmitter with a rifle in which it is possible to control the laser beam from the laser transmitter in azimuth and elevation by using adjusting means appropriate for this purpose. The system includes a case that extends longitudinally outward along the weapon. At the far front of the case, in front of the weapon, there is arranged a first optics means of generating an image of a target reticle visible to the user. In the case there is also arranged a device for securing the weapon to the base unit and changing the elevation and azimuth of the weapon in the base unit in order to aim the weapon at the target reticle image. A unit that can control the direction of the laser beam by controlling the adjusting device is removably arranged in front of the laser transmitter. The front part of the case also contains a second optics means arranged so as to receive the laser beam and generate an error signal that represents the discrepancy between the received beam and the target reticle.

Finally, a control circuit is connected to the control unit and the second optics means to control the adjusting means of the laser transmitter by using the error signal sent thereto, so that the laser beam is aimed at the reticle.

As noted, the system is intended for small arms, and requires that the weapon be arranged securely and correctly in the case.

DESCRIPTION OF THE INVENTION

One purpose of the invention is to enable alignment of firing simulators for weapons other than small arms.

This has been achieved by means of a system of the type described above, the design of which is independent of the distance between the sight and the barrel. The system is characterized in that it contains a sighting mark at which the aiming means of the weapon are to be aimed during alignment. In connection with the sighting mark there are arranged means for emitting a beam along an axis representing the aligned simulation axis. In one embodiment, the sighting mark and the means for emitting a beam are arranged on a common alignment panel. An aligning unit that is deployable at the simulator contains optics means intended to reflect at least a first part of the beam emitted by the beam element along an axis representing the current position of the simulation axis. The aligning unit further comprises position-indicating means arranged so that the beam along the axis representing the aligned beam strikes the position-indicating means at a point representing a set-point value for the simulation axis, and so that the beam along the axis representing the current simulation beam strikes the position-indicating means at a point representing an actual value for the simulation axis.

According to one embodiment, the beam element in the simulator is used to generate both the beam along the axis representing the current simulation axis and the beam emitted along the axis representing the intended aligned simulation axis. In this embodiment the optics means include lobe-forming elements that are arranged so that at least a part of the beam that is not reflected along the axis representing the current simulation axis modifies the beam lobe so that it essentially covers the adjustment range of the adjusting means for the simulation axis. In this embodiment, the means arranged at the sighting mark to emit a beam include a reflecting element in the form of, e.g. a retroreflector prism that is arranged so as to reflect that part of the modified beam lobe that strikes the reflecting element.

In one exemplary embodiment the reflecting element is arranged at a distance from the aiming mark that corresponds to the distance between the weapon sight and the barrel in a plane transverse to the simulation axis and the sight line of the aiming means, in order to eliminate parallax error.

According to one embodiment, the system aligning unit has a control unit that determines the relative relationship between the actual value and the set-point value derived from the position-indicating means and, based on this relative discrepancy, generates a control signal that is fed to a mechanism that drives the adjusting means. In this way the need for manual adjustment of the simulator adjusting means is eliminated, as this can be difficult and time-consuming on weapons in which the distance between sight and simulator is large. For example, the adjusting means can be realized as one or more optical wedges of known type, and the drive mechanism can consist of, e.g. a conventional motor. In one embodiment with a servomotor, signals corresponding to the actual and set-point values are fed to the motor in a conventional manner.

In one embodiment the control signals are transferred between the aligning unit and the firing simulator via optical communication between the units, while in an alternative embodiment they are transferred via radio communications and, in yet another embodiment, they are transferred via an electrical link between the units. The solutions that involve optical or radio communications obviously offer an advantage in that the mounting of the aligning unit at the firing simulator is simpler, since no electrical connections are necessary between the units.

In an embodiment in which the axis representing the current simulation axis is parallel with the simulation axis, the means arranged to reflect a first part of the beam include a retroreflector prism arranged in the beam path of the simulation beam, which prism is arranged so as to reflect the beam along an axis parallel with the simulation beam.

The invention offers a number of advantages over prior art technologies. The most important advantage is of course the fact that the invention also works for weapons types, such as cannon, in which the distance between the sight and the barrel precludes the use of prior art solutions. In addition, it is a very simple matter to mount the aligning unit according to the invention on top of the simulator. It is necessary only to arrange the aligning unit on top of the simulator, see to it that the transmission of control data between the aligning unit and the firing simulator is ensured, and then to aim the weapon sight at a target panel deployed at a distance from the weapon and turn on the simulator beam source. The adjustment of the aligning unit at the firing simulator is not critical, owing to the design and function of the aligning unit. The actual and set-point values will be registered correctly as long as the aligning unit is mounted in such a way that the transmission of the beam and the control signals is ensured.

PREFERRED EMBODIMENTS

Figure 1:
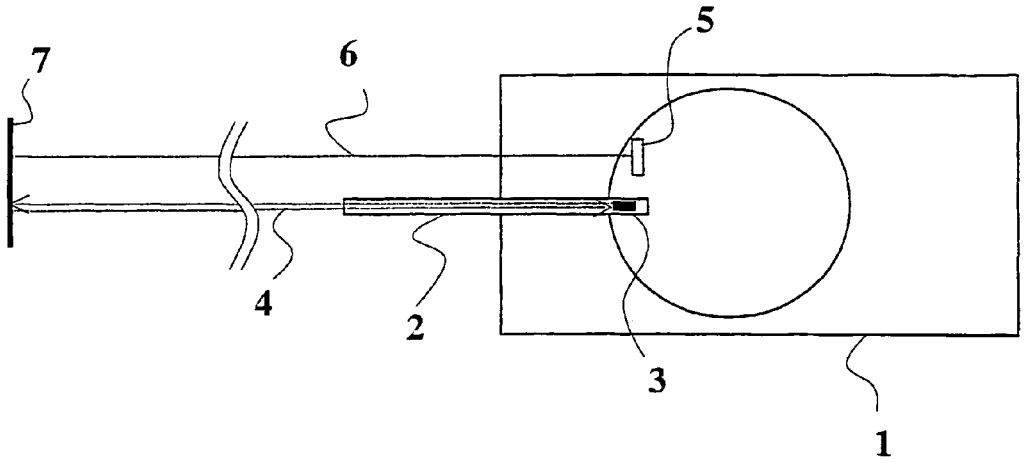
FIG. 1 shows a top view of a weapon with a firing simulator that is aligned toward an alignment panel.

In FIG. 1, reference number 1 indicates a tank equipped with a weapon such as a cannon. On the weapon barrel 2 there is arranged a firing simulator 3 which, to simulate firing of the cannon, emits a simulation beam along a simulation axis 4. The cannon also has a sight 5. The cannon sight 5 defines an aiming axis 6, and it is this aiming axis that defines the direction in which a round will leave the weapon if live ammunition is fired. To align the firing simulator, an alignment panel 7 is arranged at a distance from the cannon, e.g. between 100 m and 1000 m from the cannon. This will be described in greater detail below.

Figure 2A:
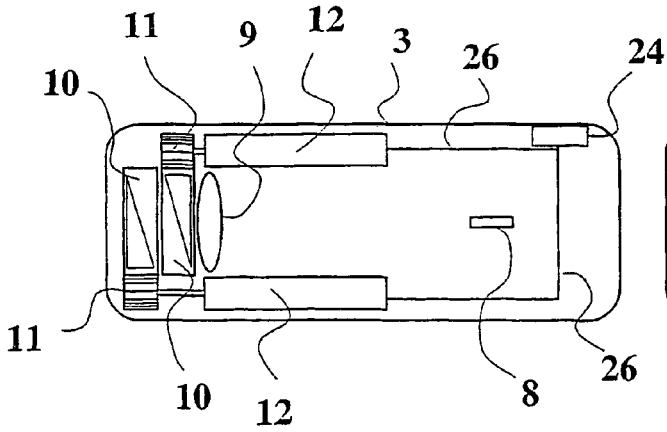
FIG. 2*a* shows a side view of an exemplary firing simulator according to the invention.

In FIG. 2*a*, a source 8 for generating a simulation beam in the form of an electromagnetic beam generated by laser technology or some other technology is arranged in the firing simulator. For example, the simulation beam source 8 is an IR laser diode. In addition, the beam source 8 is arranged at an optical distance from a lobe-forming element 9 in the form of, e.g. a lens arranged so as to change the beam from the beam source 8 into a lobe, wherein the lens 9 is designed to optimize the lobe. In the beam path after the lens 9 there are arranged one or more optical wedges 10, which are rotatable for setting and adjusting the simulation axis 4 extending from the firing simulator 3. In the embodiment depicted in FIG. 2*a*, the wedges 10 are realized in the form of a wedge pair. Each of the wedges 10 is connected via a set of gears 11 to an associated servomotor 12. Each wedge is rotatable between two end positions selected so that the simulation axis 4 is able to deviate e.g. ±10 mrad relative to the beam axis from the beam source 8. Each servomotor is controlled based on a control signal sent thereto in order to adjust the position of its associated wedge 10 (rotational position) via the gear set 11. The control signals for controlling the adjustment of the rotational positions of the wedges arrive at the firing simulator via a receiver unit 24 and are fed via wires 26 to the motors 12. The generation and transmission of the control signals to the receiver unit 24 will be described in greater detail below.

Figure 2B:
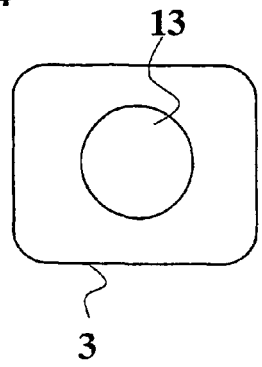
FIG. 2*b* shows a front view of the firing simulator in FIG. 2*a;*

Reference number 13 in FIG. 2*b* designates an aperture in the firing simulator 3. The aperture 13 is located in front of the beam source 8 so as to allow the simulation beam to leave the firing simulator. The size of the aperture 13 is chosen so that the simulation beam can pass through the aperture within the entire possible angular range of the simulation axis 4.

Figure 3A:
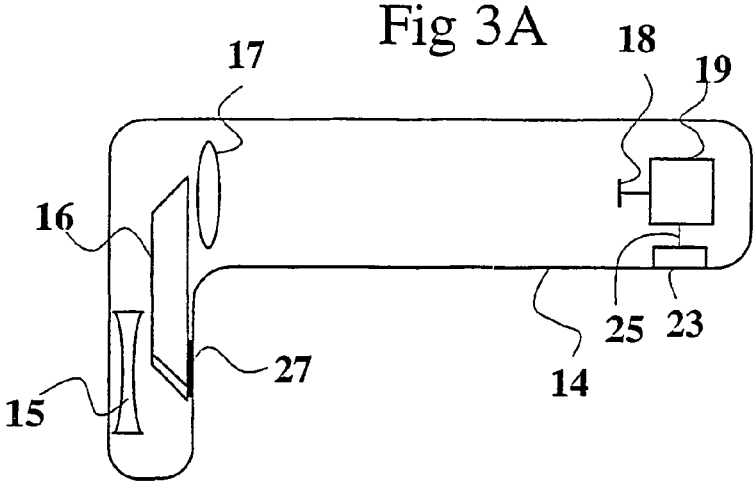
FIG. 3*a* shows a side view of an embodiment of an aligning unit according to the invention.

Reference number 14 in FIG. 3*a* designates an aligning unit for mounting on top of a firing simulator 3. As FIGS. 4 and 6 indicate, the aligning unit is designed so that it has a section that, in the mounted position, extends down over the front of the firing simulator. The downwardly extending section includes a concave lens 15 that is positioned over the aperture 13 of the firing simulator when the aligning unit 14 is in its mounted position. In one exemplary embodiment, the concave lens 15 has the same diameter as the aperture 13, or is somewhat larger. The lens 15 is arranged so as to broaden the beam lobe of the simulation beam. In one exemplary embodiment the lens 15 is designed in such a way that the beam lobe essentially covers all the possible simulation axis angles from the simulator as per the foregoing.

In the extending section, a retroreflector prism 16 also protrudes in front of the concave lens 15, so that both the retroreflector prism 16 and the concave lens are visible through the aperture. In the beam path in front of the retroreflector prism there is arranged a filter 27 that is intended to filter out a portion of the beam striking the retroreflector prism 16.

The retroreflector prism 16 characteristically consists of a roof prism and a mirror. The roof prism and the mirror are arranged at a distance from one another, and have mutually opposing reflecting surfaces exhibiting the same angle of inclination. As noted above, a beam bundle from the simulation beam strikes the roof prism of the retroreflector prism after being filtered via the filter 27. The roof prism reflects the beam bundle at the mirror, which in turn reflects the beam out from the retroreflector prism along an axis that is parallel and opposite to the current orientation of the simulation axis 4 and located at a distance from the simulation axis. The beam bundle traveling out from the prism is thus directed oppositely to the incoming beam bundle, regardless of the adjustment of the retroreflector prism, as long as the retroreflector prism is arranged in such a way that the beam bundle can pass.

In the beam path after the retroreflector prism there is arranged an objective 17, such as a camera objective, which may be equipped with a protective sun filter. The objective 17 is arranged in such a way that a part of it extends outside of the retroreflector prism.

In the focal plane of the objective 17 there is arranged a position-sensing photoelement 18. The photosensitive element may consist of, e.g. a PSD (Position Sensing Detector), a CCD array, an array of analog photoelements based on, e.g. CMOS technology, or an array of some type of digital photoelements.

The beam bundle reflected in the retroreflector prism thus strikes the objective and is focused on the photoelement 18. The coordinates of the point where the beam bundle strikes the photoelement, which represent the current setting of the simulation axis, are registered as an actual value for the simulation axis setting. The registered value is transmitted via an interface (not shown) to a processing and control unit 19. The processing and control unit 19 is connected via a wire 25 to a transmitter unit 23 for transmitting the control signals.

Figure 3B:
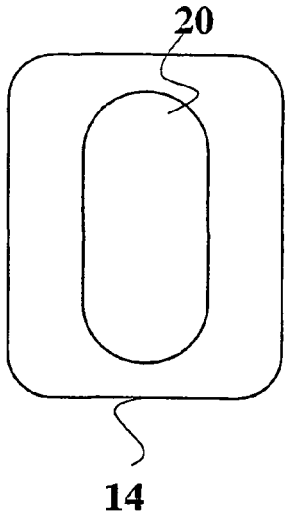
FIG. 3*b* shows a front view of the aligning unit in FIG. 3*a;*

In FIG. 3*b*, an opening 20 is depicted in the front of the aligning unit 14. The opening 20 exposes the aperture 13 in the firing simulator, and the aligning unit objective 17.

Figure 4:
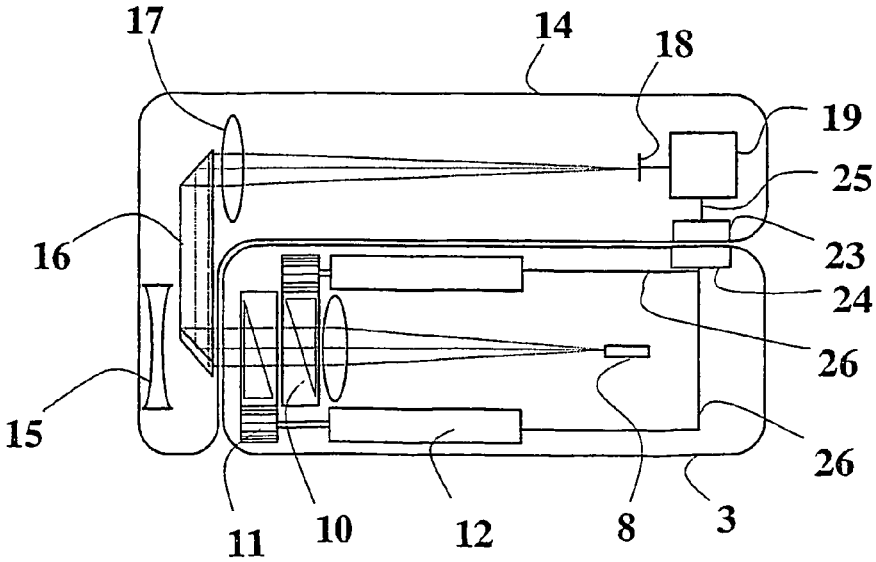
FIG. 4 shows a side view of the aligning unit mounted on the firing simulator for a first beam path.

In FIG. 4 the aligning unit 14 is mounted on the firing simulator 3. The figure shows how the aforedescribed beam bundle of the simulation beam from the simulator strikes the retroreflector prism 16 of the aligning unit, is reflected by the retroreflector prism and passes through the objective 17 before finally being focused on the position-sensing photoelement, whereupon the coordinates of the point of incidence on the element are registered. In the mounted position, the transmitter unit 23 and the receiver unit 24 are positioned relative to one another in such a way that the receiver can receive the control signals. In one exemplary embodiment, the transmitter unit 23 contains a converter (not shown) that converts the electrical signal received via the wire 25 into an optical signal that is transmitted to the receiver 24. The receiver 24 in this exemplary embodiment has a corresponding converter that converts the received optical signal into an electrical signal, which is fed to the motors 12 via the wires 26. In an alternative embodiment, transmission and reception occur via radio communication. An embodiment in which the transmitter 23 and receiver 24 are replaced with male and female electrical connectors or the like for electrical communication is also conceivable.

Figure 5:
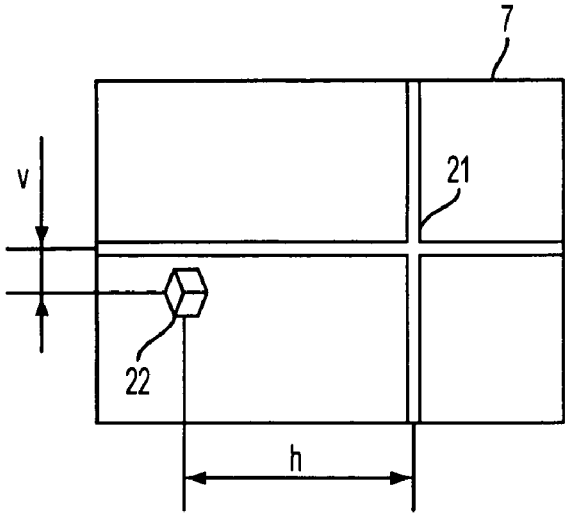
FIG. 5 shows an example of an alignment panel for use in achieving alignment by means of the aligning unit.

Reference number 21 in FIG. 5 designates a sighting mark on the alignment panel 7, at which the weapon sight 5 is aimed during the alignment procedure. The alignment panel 7 also has a retroreflector prism 22 arranged at a distance from the sighting mark 21 that corresponds to the distance between the weapon sight 5 and the barrel 2 on which the simulator is arranged. Parallax error is eliminated in this way. The existence of alternative methods for eliminating parallax error will be obvious to one skilled in the art. The fact that the value of the simulation axis setting is registered at a distance from the simulation axis is compensated for by using a retroreflector prism 22 that is identical in design with the retroreflector prism 16.

The aforedescribed concave lens 15 broadens the beam lobe for that part of the simulation beam from the simulator that does not strike the retroreflector prism 16. The part of the beam from the aligning unit that strikes the retroreflector prism 22 is reflected back to the aligning unit along an axis that is representative of the aligned beam.

Figure 6:
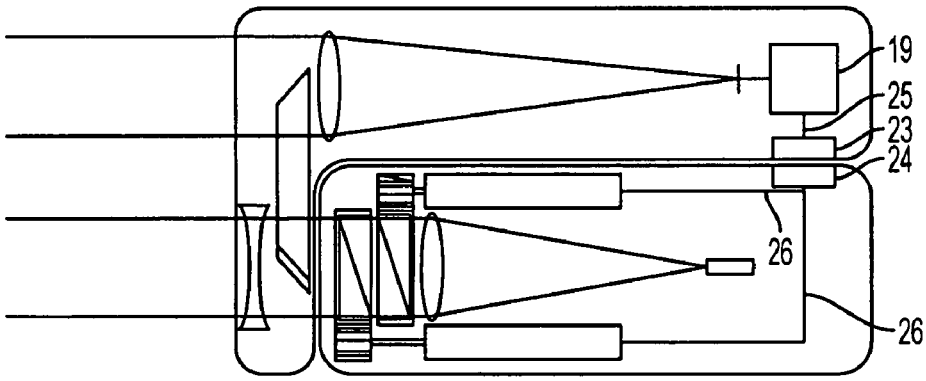
FIG. 6 shows a side view of the aligning unit mounted on the firing simulator for a second beam path.

In FIG. 6 the aligning unit objective is arranged so that it is partially visible through the opening 20 and partially covered by the retroreflector prism 16. The beam reflected from the retroreflector prism passes through the opening 20 in order to strike the objective 17. The objective 17 in turn focuses the beam toward the position-sensing photoelement 18. The coordinates of the point of incidence on the photoelement 18 are registered. The registered coordinates represent a set-point value for the simulation axis 4. The registered set-point value is transmitted via an interface (not shown) to the processing and control unit 19.

The processing and control unit 19 in the form of, e.g. a computer determines the relative distance between the point of incidence for the beam via the alignment panel, which represents the set-point value, and the beam via the retroreflector prism 16 in the aligning unit, which represents the actual value for the beam, based on the coordinates representing the actual and set-point values obtained from the position-indicating photoelement. Based on this relative distance, the control unit generates a control signal to control the servomotors in the firing simulator 3, which in turn control the wedge settings. Once the wedges have been positioned, the alignment procedure can be repeated: the sight is kept aimed at the aiming mark on the alignment panel, and the simulation beam is sent out via the two aforedescribed paths so that new actual and set-point values can be registered by the position-indicating photoelement. If the discrepancy between the actual and set-point values is less than a predetermined specified value, then the simulator is assumed to be aligned with the weapon. The aligning unit 14 can then be removed from the filing simulator 3, whereupon the firing simulator is ready for use.

Figure 7:
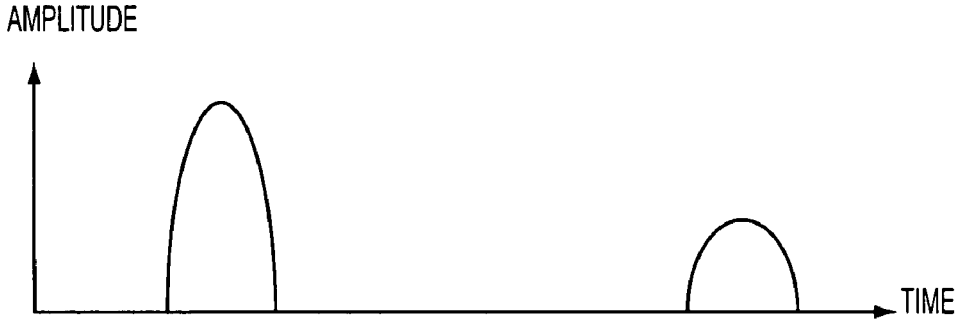
FIG. 7 shows a graph depicting the reception of pulses that have traveled along the two beam paths.

FIG. 7 shows the light intensities registered by the photoelement 18, where the first intensity peak indicates the reception of radiation that has passed through the retroreflector prism |16| of the aligning unit, and the second intensity peak indicates the reception of the radiation that has passed through the retroreflector prism 22 of the alignment panel. For example, the duration of the pulse from the simulation beam source is on the order of 100-150 ns. The time interval between the first and second intensity peaks naturally depends on the distance between the simulator and the alignment panel. At a distance of 100 m between the panel and the simulator, the time interval between the intensity peaks will be 670 ns.

For optimum results in registering the intensity peaks, their amplitudes should be of the same order of magnitude. As a rule of thumb, 0.01% of the emitted beam will strike the photoelement if the alignment panel is positioned roughly 100 m from the firing simulator and the concave lens creates a beam lobe that deviates by ±10 mrad from the simulation axis. The way in which the placement of the retroreflector prism 16 relative to the lens 15 and the filtering capacity of the filter should be controlled in order, based on the distance between the target panel and the firing simulator, to obtain at the photoelement the same order of magnitude for the beam passing via the target panel and the beam passing via the retroreflector prism 16 will be obvious to one skilled in the art.

The invention is not limited to the foregoing embodiment. For example, an embodiment is possible in which the retroreflector prism 22 at the alignment panel is replaced with a transmitter of electromagnetic radiation that emits a beam along the aligned simulation axis.

The invention claimed is:

1. A system for aligning a simulator arranged for firing and mounted on a weapon, which weapon has aiming means, wherein the simulator is equipped with at least one element arranged so as to emit an electromagnetic beam out of the simulator along a simulation axis, and adjusting means arranged in the path of the electromagnetic beam and operable to adjust the simulation axis so that it is aligned with an aiming axis, the system including:

a sighting mark at which the weapon aiming means are to be aimed during alignment so as to define the aiming axis from the weapon to the sighting mark, and means arranged in connection with the sighting mark to emit a beam along an axis representing the aligned simulation axis, and an aligning unit that is deployable at the simulator and contains optics means arranged to reflect at least a first part of the beam emitted from the element along an axis representing the current position of the simulation axis, and position-indicating means arranged so that the beam along the axis representing the aligned simulation axis strikes the position-indicating means at a point representing a set-point value for the simulation axis, and so that the beam along the axis representing the current simulation beam strikes the position indicating means at a point representing an actual value for simulation axis, and a control unit communicating with the adjusting means, the control unit generating a control signal for the adjusting means, the control signal being based on a relative distance between the point representing the set-point value for the simulation axis and the point representing the actual value for the simulation axis, the adjusting means aligning the simulation axis with the aiming axis based on the control signal.

2. A system according to claim 1, wherein the optics means include lobe-forming elements arranged so as to modify the beam lobe for at least a second part of the beam emitted from the element so that it essentially covers the adjustment range of the adjusting means for the simulation axis, and in the means arranged to emit a beam include a reflecting element arranged so as to reflect the part of the modified beam lobe that strikes the reflecting element.

3. A system according to claim 2, wherein the reflecting element is a retroreflector prism.

4. A system according to claim 2, wherein the reflecting element is positioned relative to the sighting mark in such a way that parallax error is eliminated.

5. A system according to claim 2, wherein the sighting mark and the reflecting element are arranged on a target panel.

6. A system according to claim 1, wherein the aligning unit and the simulator include means for transmitting information between them, and in that the aligning unit is arranged to transmit, via said transmitting means, the control signal corresponding to the relative distance between the actual and set-point values to at least one drive mechanism, which is arranged in the firing simulator and controls the adjusting means.

7. A system according to claim 6, wherein the transmitting means are arranged so as to transmit the control signal as any of an optical, electrical or radio signal.

8. An aligning unit for a simulator arranged for firing an mounted on a weapon, which weapon has aiming means, wherein the simulator is equipped with at least one element arranged to emit an electromagnetic beam out of the simulator along a simulation axis and adjusting means arranged in the path of the electromagnetic beam operable to adjust the simulation axis so that it is aligned with an aiming axis, characterized in that the system includes optics means arranged so as to reflect at least a first part of the beam along an axis representing the current position of the simulation axis, position-indicating means arranged so that the beam along an axis representing the aligned simulation axis strikes the position-indicating means at a point representing a set-point value for the simulation axis, and so that the beam along the axis representing the current simulation beam strikes the position-indicating means at a point representing an actual value for the simulation axis, and a control unit communicating with the adjusting means, the control unit generating a control signal for the adjusting means, the control signal being based on a relative distance between the point representing the set-point value for the simulation axis and the point representing the actual value for the simulation axis, the adjusting means aligning the simulation axis with the aiming axis based on the control signal.

9. An aligned unit according to claim 8, wherein the optics means include lobe-forming elements arranged so as to modify the beam lobe for at least a second part of the beam so that it essentially covers the adjusting range of the adjusting means for the simulation axis.

10. An aligning unit according to claim 8, wherein the adjusting means include at least one optical wedge arranged in the beam path.

11. An aligning unit according to claim 8, further comprising means for determining the coordinates of the actual value in relation to the coordinates of the set-point value on the position-indicating means.

12. An aligning unit according to claim 8, further comprising transmitter unit arranged so as to transmit the control signal to the firing simulator.

13. An aligning unit according to claim 12, wherein transmitter unit transmits the control signal as any one of an optical, electrical or radio signal.

14. An aligning according to claim 8, wherein the optic means arranged to reflect a first beam part include a retroreflector prism positioned in the beam path of the simulation beam and arranged so as to reflect the beam along an axis parallel with the simulation beam.

* * * * *